US006158364A

United States Patent [19]

Orii et al.

[11] Patent Number: 6,158,364

[45] Date of Patent: Dec. 12, 2000

[54] EMBROIDERY STITCH DATA PRODUCING DEVICE WITH SELECTIVE DESIGNATION CONFIRMING FUNCTIONS

[75] Inventors: Akira Orii; Takeshi Kongo, both of Hachioji, Japan

[73] Assignee: Janome Sewing Machines Co., Ltd., Tokyo, Japan

[21] Appl. No.: 09/141,654

[22] Filed: Aug. 28, 1998

[30] Foreign Application Priority Data

Sep. 3, 1997 [JP] Japan ..... 9-256094

[51] Int. Cl.[7] ..... D05C 5/06

[52] U.S. Cl. ..... 112/102.5; 112/445; 112/470.04; 700/138

[58] Field of Search ..... 112/102.05, 470.06, 112/470.04, 445, 475.19, 454, 456, 458; 382/111; 700/138

[56] References Cited

U.S. PATENT DOCUMENTS 5,474,000 12/1995 Mizuno et al. ..... 112/102.5

5,964,169 10/1999 Kongo et al. ..... 112/102.5

*Primary Examiner*—Peter Nerbun

*Attorney, Agent, or Firm*—Nields & Lemack

[57] ABSTRACT

An embroidery stitch data producing device with selective designation confirming functions is disclosed, wherein embroidery stitch data are produced from the image data obtained from an original image for defining the outlines and the blocks enclosed by the outlines with stitch conditions including stitch types and thread colors being designated. The outlines and the blocks so designated are classified and memorized. Further the device of the invention comprises a first screen for enabling the user to selectively designate thereon the individual outlines divided at the intersection between the adjacent outlines and the blocks enclosed by the outlines, a second screen for enabling the user to confirm and temporarily and independently register thereon the stitch conditions including the colors of the designated outlines and the blocks, a third screen for indicating thereon the temporarily registered parts of image in a lump, a fourth screen for indicating thereon the temporarily registered parts of the image individually so as to enable the user to designate the stitching order of the parts, and a fifth screen for producing stitch data from the temporarily registered parts and producing indication data from the stitch data so as to enable the user to confirm the conditions of stitches of the image to be sewn.

11 Claims, 10 Drawing Sheets

| BLOCK | THREAD COLOR/STITCH | GROUP OF BLOCKS |
|---|---|---|
| ROOF WALL 80 | GREEN/HORIZONTAL | A |
| WALL 81 | BLUE/OBLIQUE | B |
| ROOF 82 | RED/HORIZONTAL | C |
| WALL 83 | YELLOW/VERTICAL | D |
| OUTLINE 90–100 | BLACK/ZIGZAG/2mm | E |

EMBROIDERY STITCH DATA PRODUCING DEVICE WITH SELECTIVE DESIGNATION CONFIRMING FUNCTIONS

BACKGROUND OF THE INVENTION AND RELATED ART STATEMENT

The present invention relates to an embroidery stitch data producing device and more particularly relates to a data producing device having the functions for indicating selective designations of the parts of an original image to be data processed in a manner that the designations and the results thereof may be optically confirmed by the user.

It has been of a general practice that the data for controlling the stitching operations of the embroidering machine or the sewing machine capable of embroidery stitching are produced by the makers and supplied to the consumers for use with their sewing machines.

However with wide spread of computer sewing machines, the user of sewing machines has come to have a desire that she makes optional original images and stitches them on the work or cloth in accordance with the image data obtained from the images. The image sensor is now generally available in the market, which may be used to read in the image data from the images drawn by the user on a paper.

When the user makes the image data from the image for stitching it on the work with use of various colors of threads, it is required to prepare so many parts of the image having different colors to be individually read in by use of the image scanner for obtaining individual image data.

In this case, it often happens that the read-in individual images are overlapped with each other due to the errors of the images to be read in or the errors of the scanner or the erroneous operation of the scanner. The image data obtained from such images will produce overlapped stitches between the adjacent images.

A stitch data producing device is disclosed in the same applicant's Japanese Application No. 2-110233, which is designed to read in the entire image at a time instead of reading so many parts of the image at so many times, and process the image data to produce outlines by means of linealizing or outlining treatment, the outlines enclosing the parts of the image to provide so many blocks, and to set optional stitch conditions to the outlines and blocks, thereby to produce the stitch data in accordance with the stitch conditions.

However it still remains to be solved to register the confirmations by the user in the RAM card recoverably in the sewing machine in a most optimal manner, the confirmations including the data indication of the entire image, the designations of the parts of the image, the designations of the stitch conditions to the parts of the image, the indications of designated parts and non-designated parts of the image, the indications of the conditions of the parts having the stitch conditions designated thereto, the indications of data processing of the designated parts being performed or having been performed, the indications of stitching order of the designated parts and the change thereof, and the indications of stitch data production in accordance with the stitching order of the parts.

It is a principal object of the present invention to solve the above mentioned problems of the prior art.

SUMMARY OF THE INVENTION

For the purpose of attaining the above mentioned object, the embroidery stitch data producing device with selective designation confirming functions of the invention comprises: means for giving image data representing an original image; means for indicating said image data; means for extracting outlines from said image data; means for acknowledging the areas enclosed by said outlines as so many blocks; means for acknowledging the outlines divided at the intersection between the adjacent outlines as so many outlines; means for selecting at least one the stitch conditions including the thread color, the stitch type and the stitch direction; means for designating said selected stitch condition to said outlines and said blocks sequentially; a first memory for temporarily registering therein said selected stitch condition and said designated outlines and blocks in combination; means for indicating said temporarily registered elements for user's confirmation; means for producing stitch data for said temporarily registered elements in accordance with said designated stitch condition; a second memory for temporarily registering therein said stitch condition and said produced stitch data in one group; means for producing indication data from said produced stitch data for indicating the condition of stitches; means for indicating thereon the conditions of stitches in accordance with said indication data; and means for registering as one pattern data all the elements which have been data processed and temporarily registered.

The image giving means may be an image scanner by way of example, or may be an interface for inputting thereat prepared bit-map data.

The means for designating said selected stitch condition to said outlines and said blocks sequentially includes a selection designating screen for indicating thereon the non-designated parts of the image, the designated parts of the image and the temporarily registered parts of the image in a manner as to be distinguishable.

The device means for indicating said temporarily registered elements for user's confirmation includes a temporary registering confirmation screen for indicating in color the parts designated with the thread color and indicating in message the other stitch conditions.

The device further includes a screen for indicating thereon said temporarily registered elements in a lumped combination with designated colors applied thereto.

The device further includes a screen for indicating thereon the temporarily registered elements in an arrangement of stitching order which may be optionally changed.

The means for indicating thereon the conditions of stitches in accordance with said indication data includes a screen for indicating thereon the elements of the image in a manner that the overlapped stitches of said elements may be confirmed.

The device further includes a means for indicating all of the elements which are indicated on the selection designating screen, the temporary registering confirmation screen, the lump indicating screen, the stitching order indicating screen and the overlapped stitch indicating screen.

The elements indicated on each of the selection designating screen, the temporary registering confirmation screen, the lump indicating screen, the stitching order indicating screen and the overlapped stitch indicating screen may be transferred to any of the other screens for data processing thereon.

Each of the above mentioned screens includes so many icons which are selectively referred to for selecting any of the other screens.

The device of the invention may be an independent one or may be incorporated in the embroidering machine, or may be partly incorporated in the embroidering machine and partly independent.

DETAILED DESCRIPTION OF PREFERRED EMBODIMENT

The invention will now be described by way of a preferred embodiment in reference to the attached drawings.

Figures 1, 5:
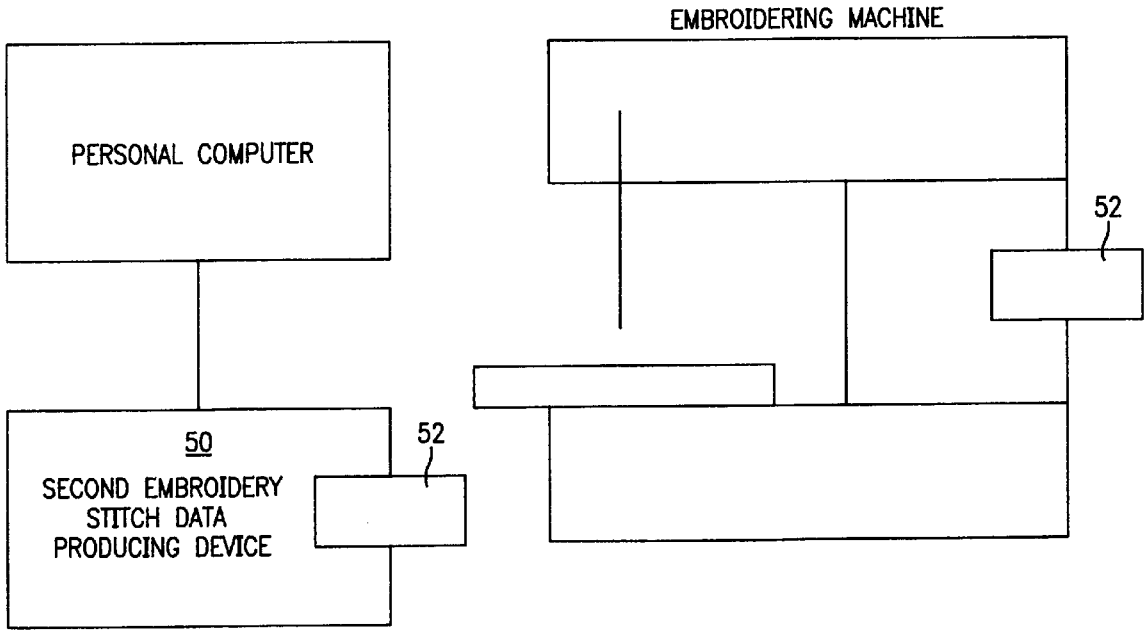
FIG. 1 is a block diagram showing a specific idea of the invention.
FIG. 5 is a description of blocks in a form of table.

FIG. 1 is a block diagram showing a specific idea of the invention, wherein a personal computer as a first embroidery stitch data producing device and a second embroidery stitch data producing device 50 are connected to each other.

The second embroidery stitch data producing device 50 has a function for producing embroidery stitch data and is adapted to have a RAM card 52 as an external memory detachably attached thereto, the RAM card being capable of recoverably storing data therein.

The RAM card 52 having embroidery stitch data stored therein may be attached to a sewing machine which is capable of embroidery stitching, so that the sewing machine may read out the embroidery stitch data from the RAM card to make the embroidery stitch on a work to be stitched.

The first embroidery stitch data producing device will now be described in reference to FIG. 2.

Figure 2:
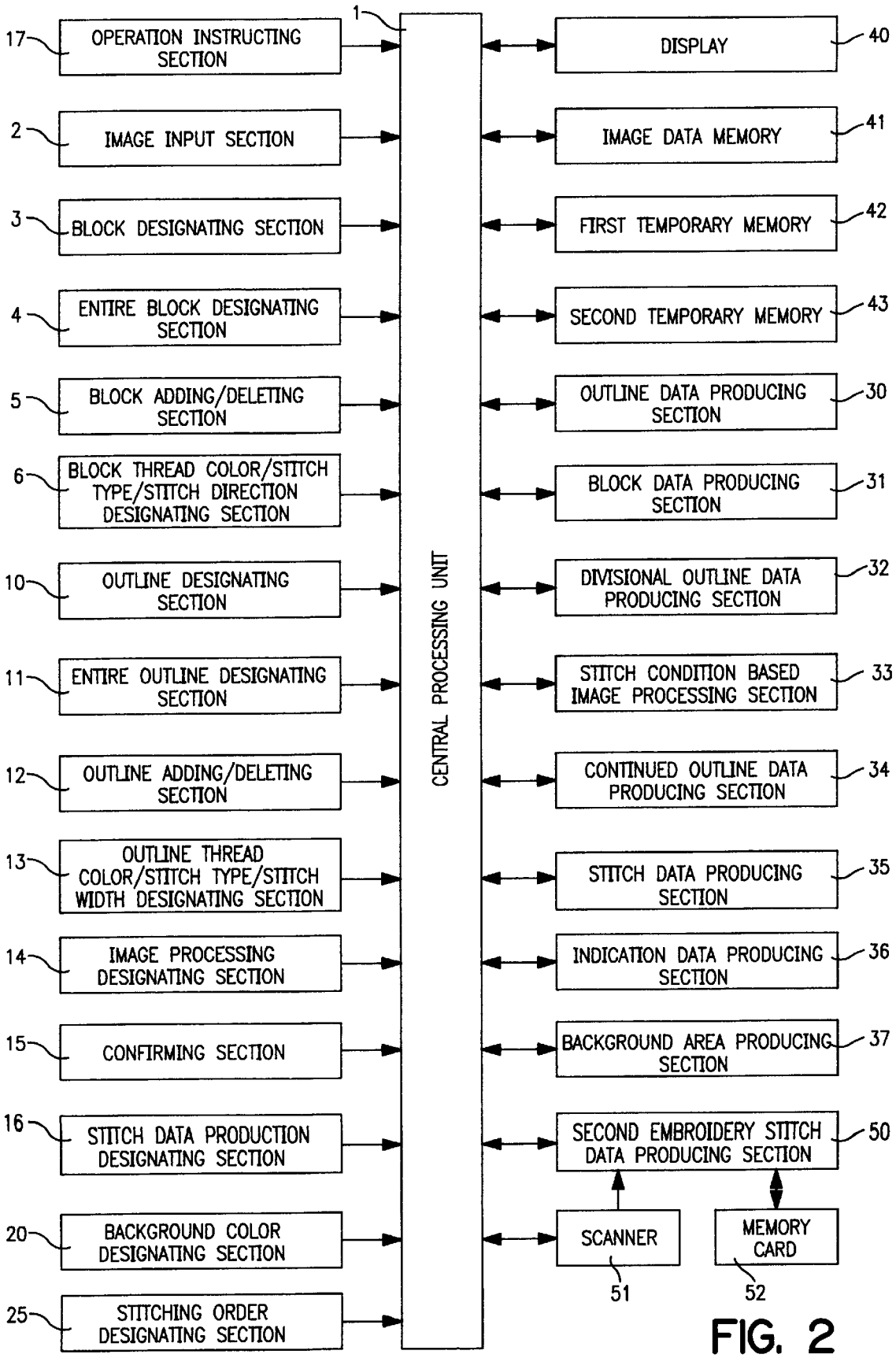
FIG. 2 is a block diagram showing a control system of the invention.

In FIG. 2, a central processing unit (CPU) 1 such as a microcomputer has many sections connected thereto.

An image input section 2 is connected to the CPU 1. The image input section may be an image scanner for giving image data to the CPU 1 by reading in the image data from an image optionally selected by the user. The image scanner may be replaced by a memory means such as a memory card or CAD.

A block designating section 3 is connected to the CPU 1. The block designating section is operated to designate the area or areas enclosed by outlines.

An entire block designating section 4 is connected to the CPU 1. The block designating section is operated to designate in entirety all of the individual areas enclosed by outlines.

A block adding/deleting section 5 is connected to the CPU 1. The block designating section is operated to add any new block to or delete any block from a group of blocks which have been already designated.

A block thread color/stitch type/stitch direction designating section 6 is connected to the CPU 1. The section 6 is operated to selectively designate the thread color, stitch type and stitch direction to be applied to the block or blocks.

An outline designating section 10 is connected to the CPU 1. The section 10 is operated to designate the outlines which are divided at the intersections between the adjacent ones. An entire outline designating section 11 is connected to the CPU 1. The section 11 is operated to designate in entirety all of the individual outlines.

An outline adding/deleting section 12 is connected to the CPU 1. The section is operated to add any new outline to or delete any outline from a group of outlines which have been already designated. An outline thread color/stitch type/stitch width designating section 13 is connected to the CPU 1. The section is operated to selectively designate a stitch condition including the thread color, stitch type and stitch width to be applied to the block or blocks.

An image processing designating section 14 is connected to the CPU 1. The section is operated to designate the blocks and outlines to be cut out from an entire image and to be indicated in independent areas as so many partial images.

A confirming section 15 is connected to the CPU 1. The section is operated to designate the partial images to be put into combination an integrated image for confirmation by the user.

A stitch data production designating section 16 is connected to the CPU 1. The section is operated to designate stitch data to be produced from the partial images respectively.

An operation instructing section 43 is connected to the CPU 1. The section is operated to designate a displayed scene to be changed and give instructions to the displayed scene. According to the invention, this section includes a mouse and a cursor to be represented on a display.

A background color designating section 20 is connected to the CPU 1. The section is operated to designate the area as a background other than the area or areas enclosed by the outlines, or the entire area of the display, and to designate a color to the background area, thereby to facilitate designation of colors to the blocks and outlines.

A stitching order designating section 25 is connected to the CPU 1. The section is operated to designate the stitching order of the blocks and outlines as optionally determined by the user.

An outline data producing section 30 is connected to the CPU 1. The section is operative to produce stitch data for the outlines from the image data given by the scanner or the like, the outline stitch data being produced by linearlizing or outlining data processing.

A block data producing section 31 is connected to the CPU 1. The section is operative to produce stitch data for the blocks, that is, the areas enclosed by the outlines, from the image data given by the scanner or the like.

A divisional outline data producing section 32 is connected to the CPU 1. The section is operative to produce stitch data for the divisional outlines which are divided at the intersections between the adjacent outlines.

A stitch condition based image processing section 33 is connected to the CPU 1. The section is operative to indicate the thread color or colors at a display 40 for the designated blocks and outlines in accordance with the color designation. A continued outline data producing section 34 is connected to the CPU 1. The section is operative to discriminate if a plurality of outlines designated in a group are connected or continued to each other, and in case the outlines are connected to each other, to produce stitch data for the continued outline so that the outlines may be successively stitched.

A stitch data producing section 35 is connected to the CPU 1. The section is operative to produce stitch data from the image data given by the scanner or the like. An indication data producing section 36 is connected to the CPU 1. The section is operative to produce data from the stitch data for indicating the image with the stitches at the display 40.

A background area producing section 37 is connected to the CPU 1. The section is operative to produce data for indicating the area as a background other than the area or areas enclosed by the outlines. More precisely the background area corresponds to the area other than the area occupied by stitches.

The display 40 is connected to the CPU 1. The display is operative to indicate thereat what is represented by the indication data.

An image data memory 41 is connected to the CPU 1. The memory is a RAM which is operative to store therein the image data inputted from the image input section 2.

A first temporary memory 42 is connected to the CPU 1. The memory is a RAM which is operative to store therein the designated condition data, block data, and outline data in combination.

A second temporary memory 43 is connected to the CPU 1. The memory is a RAM which is operative to store therein the stitch data as are produced.

A second embroidery stitch data producing section 50 is connectable to the CPU 1. The section is operative to process the image which is read in from a scanner 51 and produce embroidery stitch data from the image. The embroidery stitch data thus produced are stores in a memory card 52 (RAM card) connected to the second embroidery stitch data producing section 50.

Figure 3:
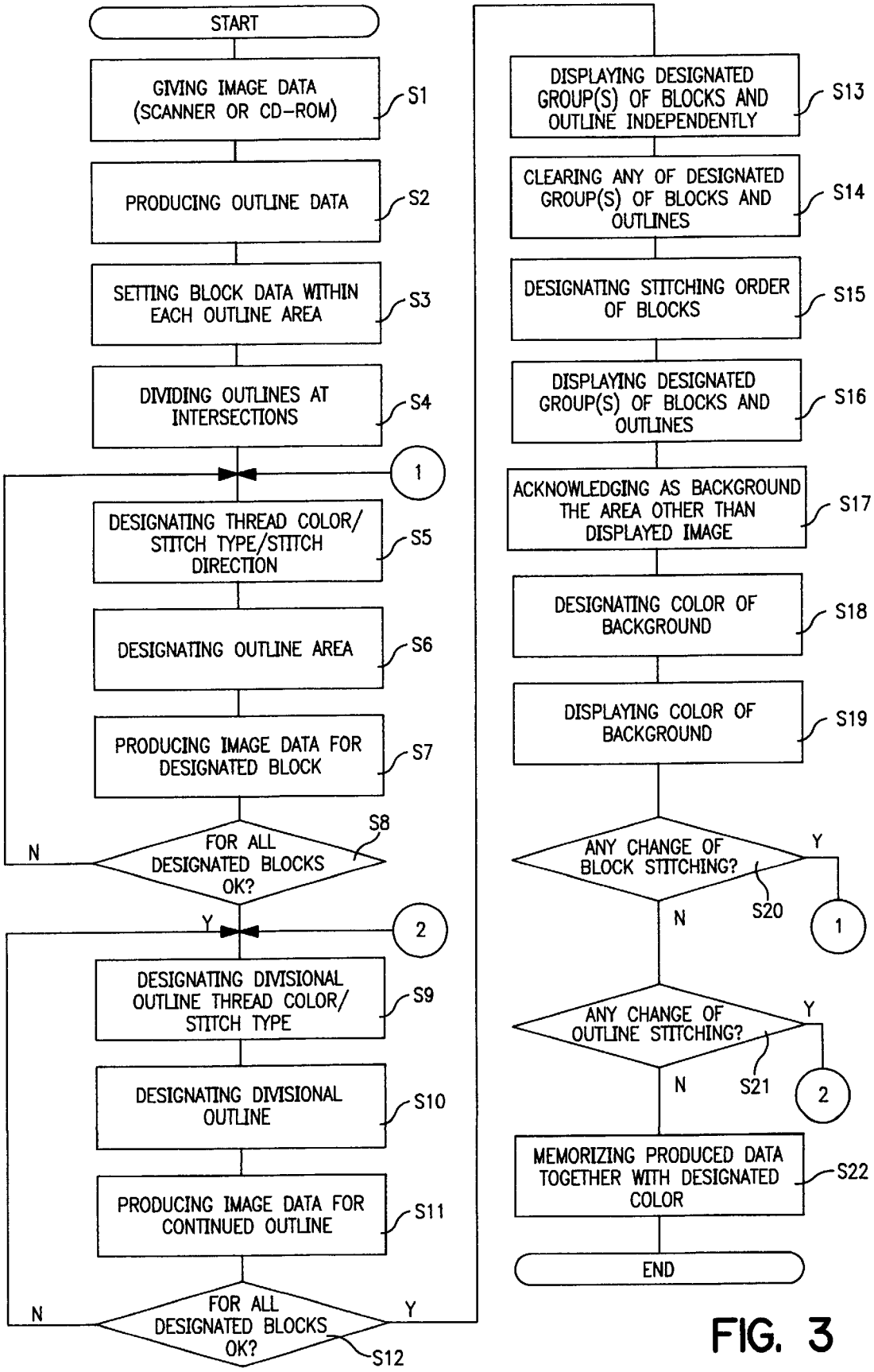
FIG. 3 is a is a flow chart showing the operations of the invention.

The operations of the embodiment of the invention will now be described in reference to FIG. 3, in case the scanner 51 is connected the to CPU 1 through the second embroidery stitch producing section 50.

At step 1(S1), the scanner 51 is operated to read in the image data from an original image. The image data which are read in are stored in the image data memory 41.

At step 2(S2), the CPU 1 causes the outline data producing section 30 to produce the outline data from the image data with a reference position being set as predetermined with respect to the indicated image, for example, the upper leftward position in the indication area where the entire image may be data processed The outlines of the image may be data processed to be linearized in a thinner line, or alternatively may be extracted from the image in dependence on the type of the image.

Figure 6:
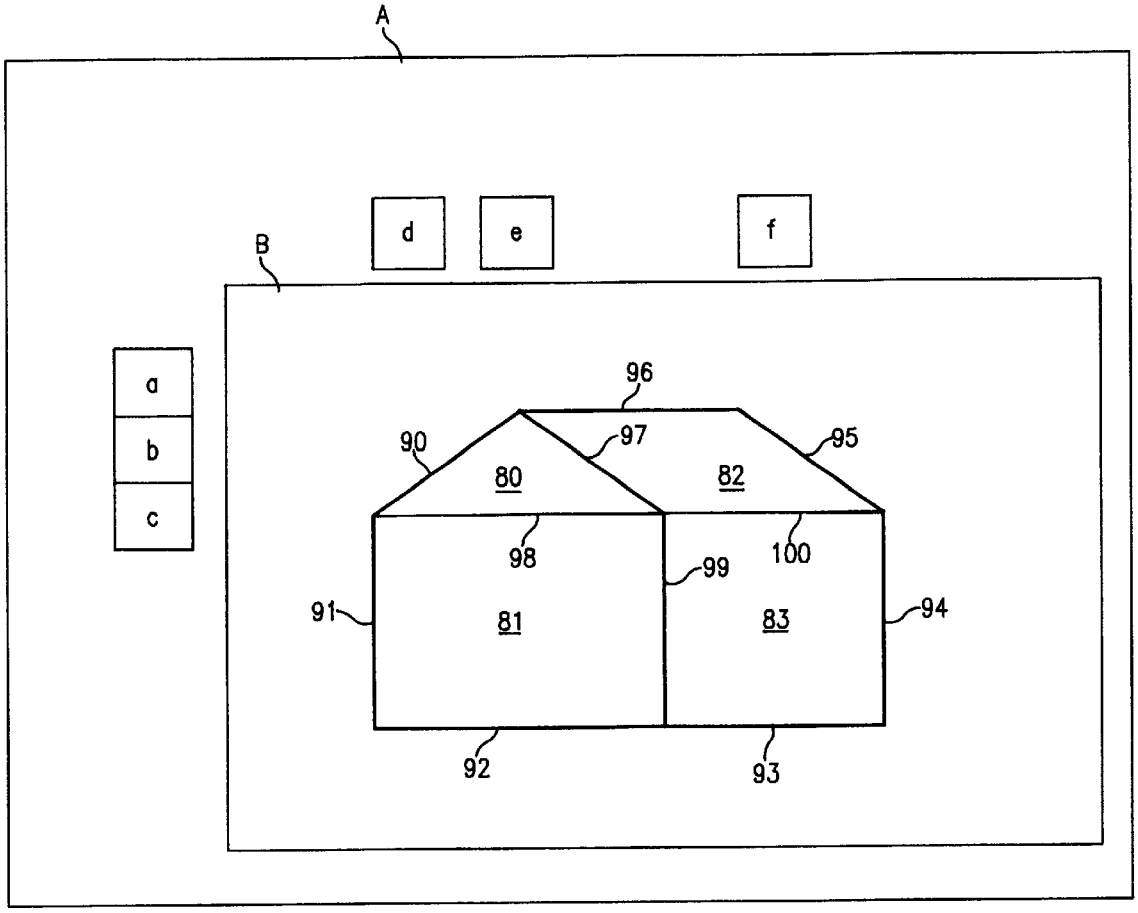
FIG. 6 is a diagram showing an element selecting screen.

FIG. 6 shows the outlines defining an image which is divided into a plurality of blocks by the outlines. The reference mark A shows an entire indication area while the reference mark B shows a reference embroidering frame area. The reference mark a is provided to be referred to for activating the block thread color/stitch type designating section 6. The reference mark b is provided to be referred to for activating the outline thread color/thread type/stitch width designating section 13. The reference mark c is provided to be referred to for activating the image processing designating section 14. The reference mark d is provided to be referred to for activating the entire outline designating section 11. The reference mark e is provided to be referred to for activating the entire block designating section 4. The reference mark f is provided to be referred to for selectively changing the indicated pictures and for activating the background color designating section 20.

At step 3(S3), the block data producing section 31 is activated to produce the block data for the divided blocks 80,81,82 and 83.

At step 4(S4), the divisional outline data producing section 32 is activated to produce the outline data for the outlines 90~100 which are divided at the intersections between the adjacent outlines. The produced outline data are indicated in the reference embroidering frame area B with the outlines being black and the blocks enclosed by the outlines being colorless as unselected areas.

At step 5(S5), the mouse, which is the operation instructing section 17, is operated to move the cursor on the display to the reference mark a which represents the stitch condition, thereby to activate the block thread color/stitch direction designating section 6 for setting the stitch conditions for the blocks.

The stitch condition includes the thread color, stitch type and stitch direction. When the stitch condition is designated as desired, the thread color is indicated at a part of the display for confirmation by the user.

The thread colors are generally standard ones which are prepared as so many palettes corresponding to the actual thread colors of the user which may be registered. These colors may be registered in such manner that the colors approximating to the actual colors are selected from the palettes and indicated at the display, or produced by compounding the colors at the display, or by inputting the color numbers, or by directly reading the colors by use of the scanner for indication and registration.

At step 6(S6), the mouse 17, which is the operation instructing section 17, is operated to move the cursor to selectively designate the embroidering blocks. Then the block designating section 3 is activated to indicate the blocks in black as distinguished from the transparent non-designated blocks. However in this case the blocks are indicated with the designated colors in accordance with the required stitch conditions.

At step 7(S7), these block images are processed in each of the blocks in accordance with the designations of stitch conditions and blocks.

Figure 7:
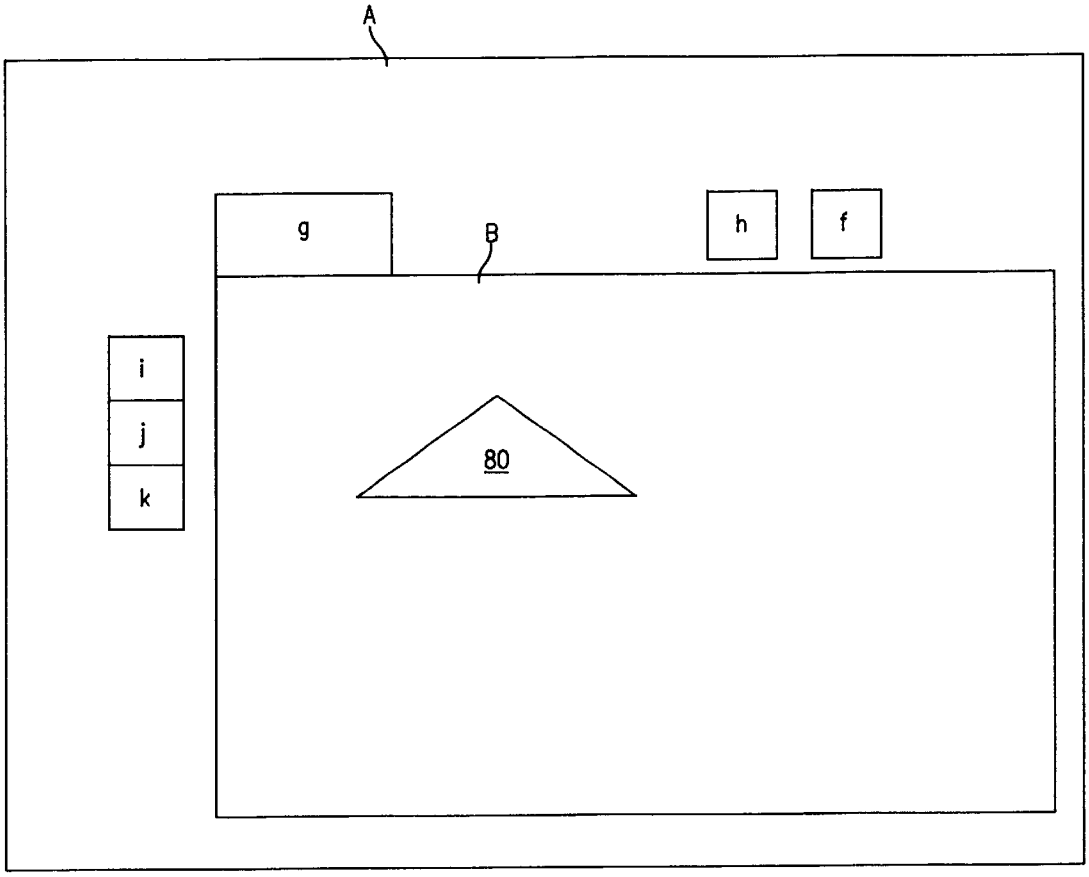
FIG. 7 is a diagram showing a screen for temporarily registering the blocks.

The mouse is operated to designate the reference mark c on the selecting screen as shown in FIG. 6, thereby to activate the image processing designating section 14 to designate the image to be processed by means of the information of the stitch conditions including the thread color, stitch type and stitch direction. The stitch condition based image processing section 33 is then activated to process the image. The processed information is temporarily stored in the temporary memory 42 and is simultaneously indicated on the temporary registering screen as shown in FIG. 7. The indicated scene is a block representation by means of color in accordance with the color information together with the other stitch conditions. On the indicated scene in FIG. 7, there are provided a reference mark g for indicating the stitch conditions, a reference mark h for activating the stitch producing section 35 and the indication data producing section 36, a reference mark i for indicating the temporarily registered image data in a lump, a reference mark j for indicating the stitching order of the blocks, a reference mark k for deleting the image processed data and the aforementioned screen changing mark f.

The temporarily stored blocks are indicated in gray as to the one or ones designated as distinguished from the non-designated ones on the selecting screen of the display in FIG. 6.

With sequential selection of the blocks after the selective designation of the stitch conditions, the blocks may be registered and indicated in a group or groups.

The cut out and data processed groups of blocks may be temporarily stored together with the stitch data and the stitch condition data in a lump.

At step 8(S8), it is discriminated if all blocks have been data processed. If not, the program is returned to step 5(S5), and the non-designated stitch conditions are sequentially designated to be data processed, and then temporarily stored.

In this case, the block designation may be made prior to the stitch condition designation.

The temporarily stored blocks may be designated again for repeatedly stitching the blocks, for example, with different stitch types.

Figure 9:
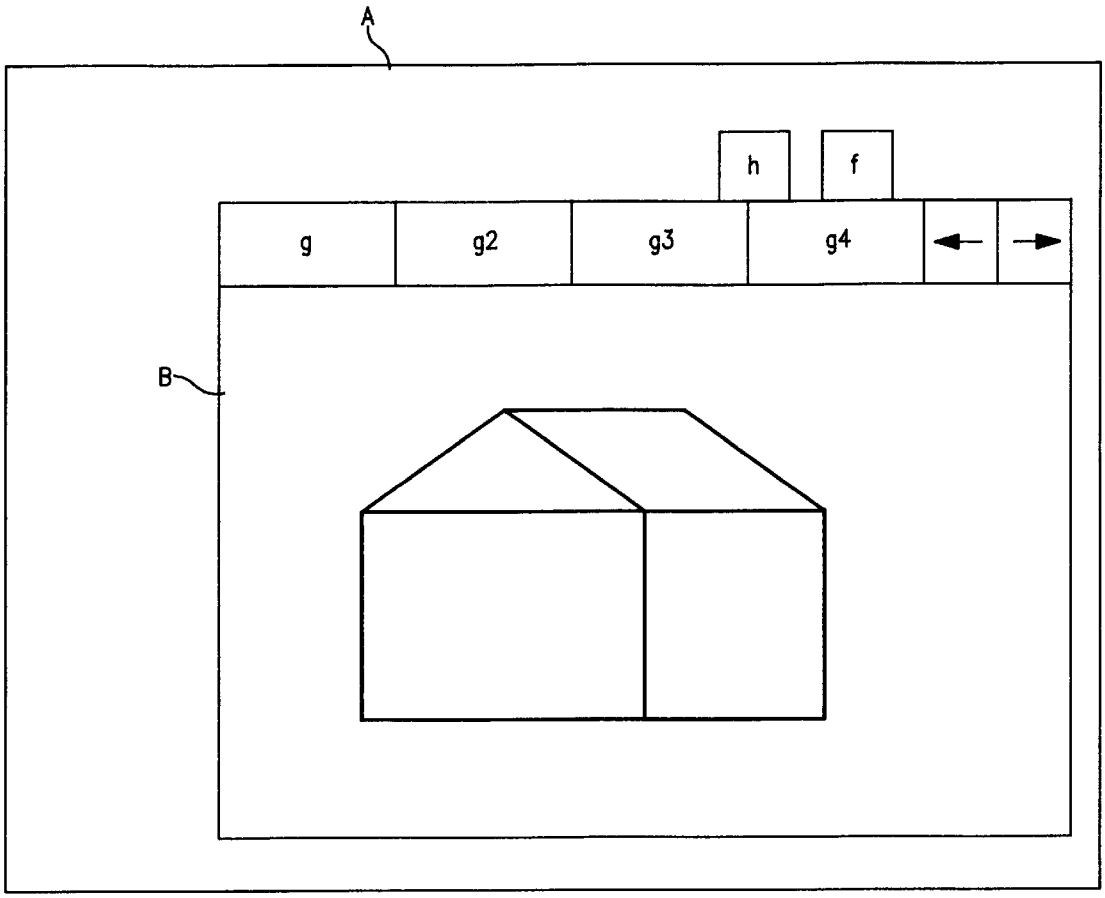
FIG. 9 is a diagram showing a screen for indicating the elements of image in a lump with the designated stitch conditions.

These data processed blocks may be indicated in a lump on the lump indicating screen of the display in FIG. 9 before all of the blocks are not data processed for a user's confirmation of the combined condition.

The lump indicating screen of the display in FIG. 9 has the screen switching reference mark f indicated thereon to be referred to for switching the lump indication screen back to the temporary registering screen on which the data processed block or blocks may be deleted for designating again the blocks from the selecting screen.

At step 9(S9), the stitch condition selecting reference mark g is designated to set the stitch conditions for the respective outlines indicated on the selected screen.

The outline thread color/stitch type/stitch width designating section 13 is then operated to indicate the designated thread color, thread type and thread width in a part of the selected screen for confirmation by the user.

Subsequently at step 10(S10), the mouse is operated to designate the outline designating section 10, which is then activated to indicate the designated outlines with red so as to be distinguished from the non-designated outlines.

Subsequently at step 11(S11), the image processing indication reference mark c is referred to for activating the stitch condition based image processing section 33 to process the image and indicate the processed image on the temporary storing indication screen of display in FIG. 8 having the same reference marks with the marks of FIG. 7 indicated therein.

In case the outlines are of a same color and continued to each other, these outlines are regarded as a single group. Then continued outline data producing section 34 is activated to produce the data for the continued outlines.

The entire outline designating section 11 may be operated to designate all of the outlines as a single group with the designated stitch conditions.

The continued outline data processing is disclosed in the Japanese Patent application No.8-130926. More precisely in reference to FIG. 6, by way of the right side selection at the intersection between the adjacent outlines, and by way of repeated stitching, the outlines are successively stitched in the order of 90-91-92-93-94-95-96-97-98-98-99-99-100-100-97-96-95-94-93-92-91-90.

In accordance with the designations of the stitch conditions and the outlines, the image is data processed for the outlines respectively. The image processing designating section 33 is operated to process the image with the information of the thread color, stitch type and stitch width. The processed image data are temporarily stored and simultaneously indicated on the temporary registering screen where the designated outlines are indicated with the color of thread color information together with the other stitch conditions.

The temporarily stored outlines are indicated in gray so as to be distinguished from the non-designated outline.

Subsequently at step 12(S12), it is discriminated if all outlines have been data processed. If not, the program is returned to step 9(S9), where the non-designated stitch conditions are sequentially designated, and the data processed outlines are temporarily stored.

In this case the outlines may be designated prior to designation of the stitch conditions.

At step 13(S13), the outlines may be confirmed in a lump on the display at each time the outline is data processed or when all outlines have been data processed.

At step 14(S14), any of the designated outlines may be deleted or any new one or ones may be optionally added to the designated outlines on the temporary registering screen.

The first temporary memory 42 will store therein the designated and data processed image in the manner as shown in FIG. 5.

Figure 8:
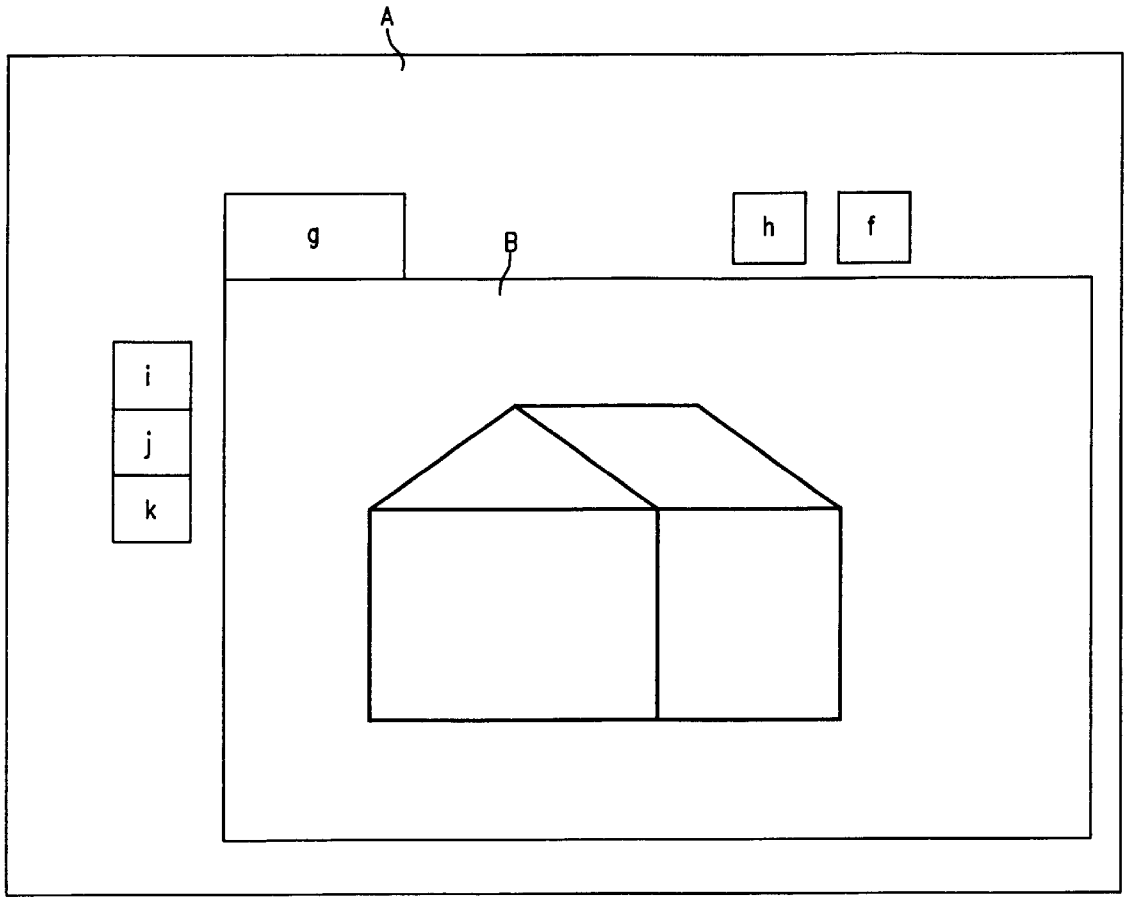
FIG. 8 is a diagram showing a screen for temporarily registering the outlines.
Figure 10:
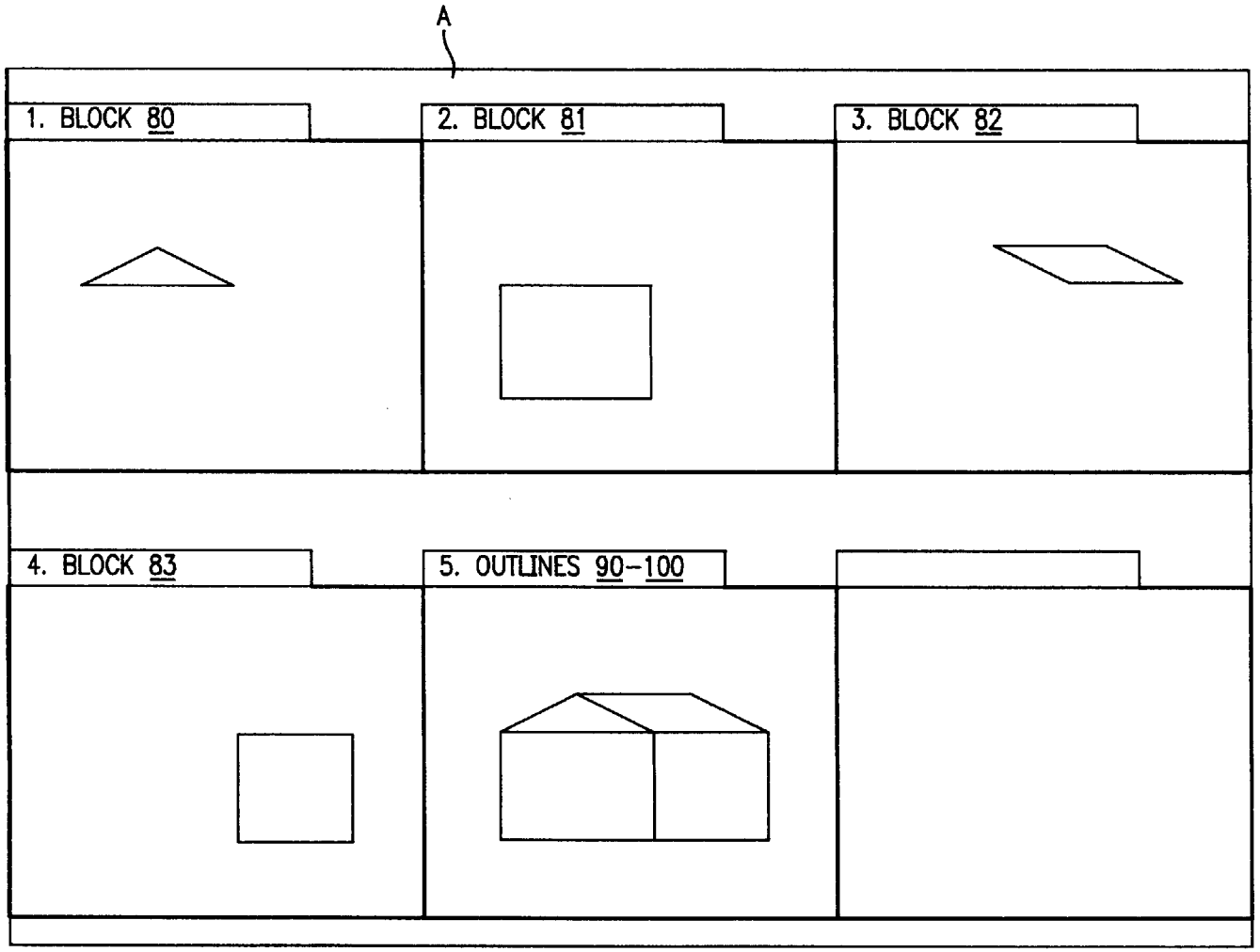
FIG. 10 is a diagram showing a screen for indicating the image to be stitched with the designated stitch conditions.
Figure 11:
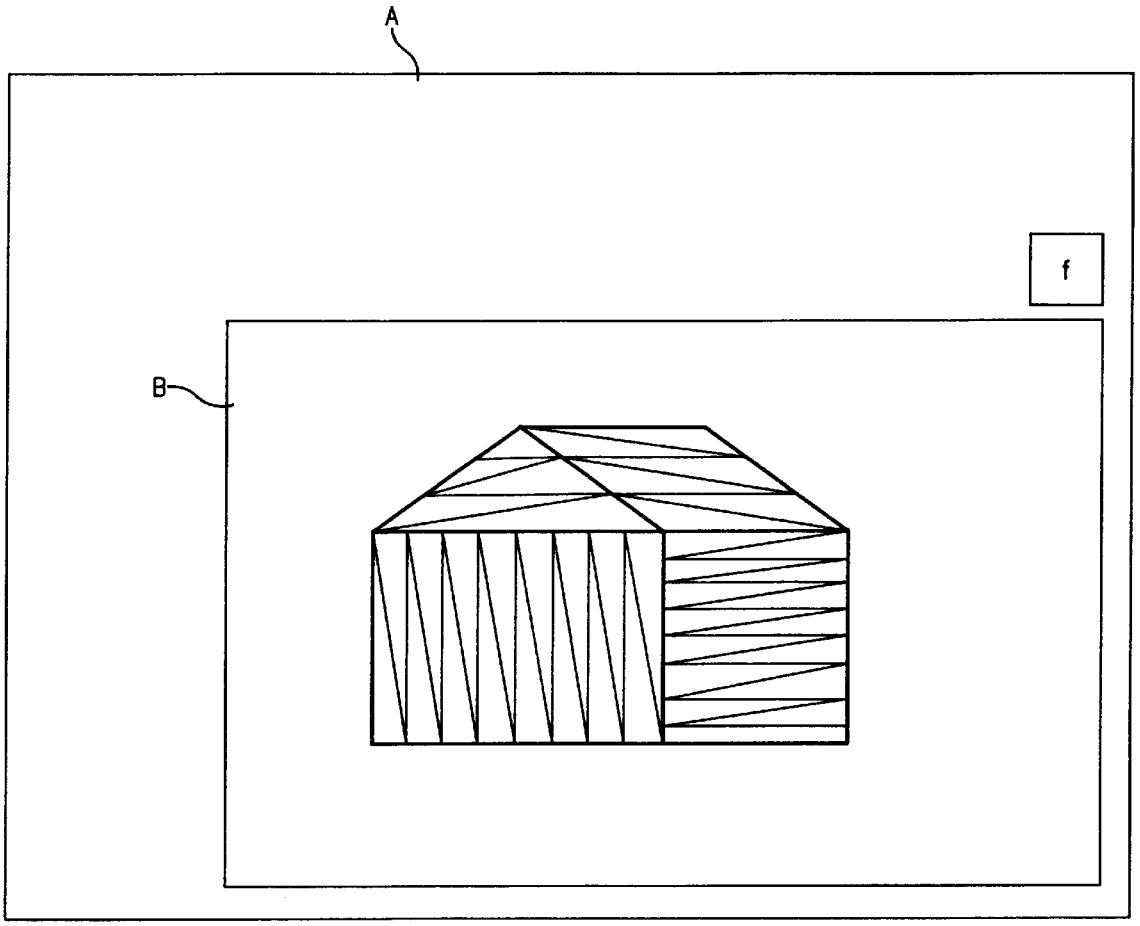
FIG. 11 is an explanatory view of a stitch screen.

At step 15(S15), the stitching order designating reference mark j as shown in the temporary registering screen of display in FIGS. 7 and 8 is referred to for arranging the temporarily stored image on the display in so many divided parts in a form of table in the stitching order as shown in FIG. 10.

In FIG. 10, the indicated objects are provided with the stitching order mummers respectively. The stitching order may be changed by referring to the optional numbers one after another by use of the mouse for registering the numbers in the first temporary memory 42.

At step 16(S16), the reference mark h for designating the production of stitch data is referred to on the temporary registering screen, thereby to activate the stitch data producing section 35 and the indication data producing section 36 to produce the stitch data and the indication data which may be further processed to enlarge or reduce the size of the image to be embroidered.

The stitch data produced from the temporarily stored stitch conditions and the data processed objects or parts are temporarily stored in the second temporary memory 43. The indication data produced from the stitch data are temporarily stored in the second temporary memory 43 and simultaneously indicated on the stitch screen of display at step 11(S11) for user's confirmation of the stitches to be actually formed for the image with respect to the balance of colors, the condition of repeated stitches, and the condition of jump threads in case there are objects to be independently stitched.

The stitch data processing may be performed and indicated for confirmation by the user after each of the individual parts has been temporarily stored or after all of the parts have been temporarily stored.

Indication of the background area will now be described.

At step 17(S17), the area of background is acknowledged as the area other than the area enclosed by the outlines on the display.

At step 18(S18), the color designating section 20 is operated to designate the color for the background area. The color may be selected on the display from the palettes. The color to be selected may be closest to the color of the work or cloth to be actually used, or may be compounded on the display to be closest to the color of the work, or may be directly read in by the color scanner from the work.

At step 19(S19), the designated color is indicated for the background area.

At steps(S20,S21), it is discriminated if the blocks and/or outlines are changed. If not, a register is selected in a menu picture (not shown) to enable the memory card (RAM card) 52 attached to the second embroidery stitch data producing section 50 to store therein the stitch data, the stitch condition data and the stitching order data given to the stitching areas respectively.

The memory card (RAM card) 52 is then attached to the embroidering machine where the stored data are read out to form stitches.

Figure 4:
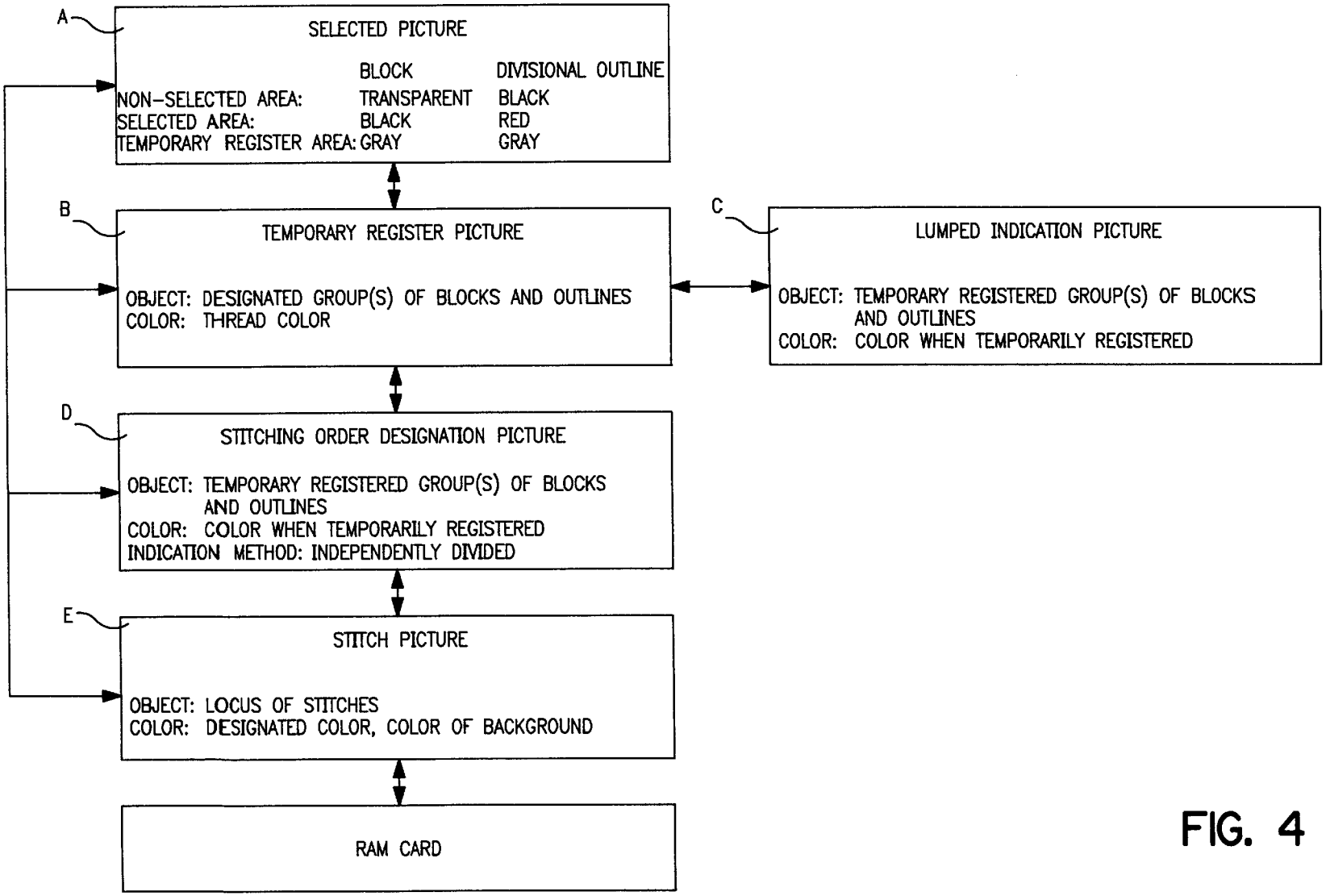
FIG. 4 is a block diagram showing the occasional indication screens for determining the processes for stitching an original image.

According to the invention, FIG. 4 shows independently the selecting screen A for indicating the part designations and the designated parts, the temporary registering screen B for indicating the blocks determined by the designated conditions, the lump indication screen C for indicating the temporarily registered conditions in a lamp, the stitching order screen D for indicating the temporarily registered pictures in an arrangement of stitching order, and the stitch screen E for indicating the entire image with the stitches to be formed together with the background which is color data processed. These screens are provided so as to be selectively viewed. These screen may be optionally switched over from one to another as required with provision of icons for the respective screens to be referred to.

Alternatively these screen may be indicated in so many windows which may be further arranged in layers.

Further the designated parts, the non-designated parts and the temporarily registered parts may be indicated partly or entirely in one screen.

Thus according to the invention as described above, the selecting screen is provided to indicate thereon the outlines of an optional original image defined by the outline data extracted from the image data, so that the blocks of the image enclosed by the outlines and the individual outlines divided at the intersections between the adjacent outlines may be selected for sequentially stitching the image.

The selecting screen will prevent the user from erroneous repeated designation of same blocks and outlines because the designated blocks and outlines are indicated as distinguished from the non-designated ones.

The temporary registering screen is provided to indicate thereon the blocks enclosed by the divided outlines with the selected stitch conditions and independently (especially in colors) for confirmation by the user.

The lump indicating screen is provided to indicate thereon the temporarily registered parts in a lump for a user's confirmation of the combination of colors before stitching.

The stitching order designating screen is provided to indicate thereon a plurality of temporarily registered parts with the stitch conditions in a stitching order for user's confirmation, so as to be reordered.

The stitching screen is provided to indicate thereon the entire image with the stitch conditions for a user's confirmation of the stitch types, and to enable the user to set the background.

Further according to the invention, the above mentioned plurality of temporarily registered parts may be moved to any other screens as required for re-selection and/or re-designation of parts.

What is claimed is:

1. An embroidery stitch data producing device with selective designation confirming functions comprising:

means for giving image data representing an original image;

means for indicating said image data;

means for extracting outlines from said image data;

means for acknowledging the areas enclosed by said outlines as so many blocks;

means for acknowledging the outlines divided at the intersection between the adjacent outlines as so many outlines;

means for selecting at least one of the stitch conditions including the thread color, the stitch type and the stitch direction;

means for designating said at least one selected stitch condition to said outlines and said blocks sequentially;

a first memory for temporarily registering therein said at least one selected stitch condition and said designated outlines and blocks in combination;

means for indicating said temporarily registered elements for a user's confirmation;

means for producing stitch data for said temporarily registered elements in accordance with said at least one designated stitch condition;

a second memory for temporarily registering therein said at least one stitch condition and said produced stitch data in one group;

means for producing indication data from said produced stitch data for indicating the condition of stitches;

means for indicating thereon the conditions of stitches in accordance with said indication data; and means for registering as one pattern data all the elements which have been data processed and temporarily registered.

2. The device as defined in claim 1, wherein said image data giving means is an image scanner for reading in said original image.

3. The device as defined in claim 1, wherein said image data giving means is an interface for reading in an image from a prepared image file.

4. The device as defined in claim 1, wherein said means for designating said at least one selected stitch condition to said outlines and said blocks sequentially includes a selection designating screen for indicating thereon the designated elements, non-designated elements and temporarily registered elements in a distinguishable manner.

5. The device as defined in claim 1, wherein said means for indicating said temporarily registered elements for a user's confirmation includes a temporary registering confirmation screen for indicating in color the parts designated with said thread color and indicating in a message the other stitch conditions.

6. The device as defined in claim 1, further comprising a screen for indicating thereon said temporarily registered elements in a lumped combination with designated colors applied thereto.

7. The device as defined in claim 1, further comprising a screen for indicating thereon said temporarily registered elements in an arrangement of stitching order which may be optionally changed.

8. The device as defined in claim 1, wherein said means for indicating thereon the conditions of stitches in accordance with said indication data includes a screen for indicating thereon the elements of said image in a manner that the overlapped stitches of said elements may be confirmed.

9. The device as defined in claim 1, further comprising a means for indicating all of the elements which are indicated on said selection designating screen, said temporary registering confirmation screen, said lump indicating screen, said stitching order indicating screen and said overlapped stitch indicating screen.

10. The device as defined in claim 9, wherein the elements indicated on each of said selection designating screen, said temporary registering confirmation screen, said lump indicating screen, said stitching order indicating screen and said overlapped stitch indicating screen may be transferred to any of the other screens for data processing thereon.

11. The device as defined in claim 10, wherein each of said screens includes so many icons which are selectively referred to for selecting any of the other screens.

* * * * *